US007686237B2

(12) United States Patent
Wanbaugh et al.

(10) Patent No.: US 7,686,237 B2
(45) **Date of Patent: *Mar. 30, 2010**

(54) DISCHARGE/VENT MODULE FOR POWER SPRAYER

(75) Inventors: Linn D. Wanbaugh, Blue Springs, MO (US); Robert J. Good, Lee's Summit, MO (US); Steve Sweeton, Lake Winnebago, MO (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 21 days.

This patent is subject to a terminal disclaimer.

(21) Appl. No.: 11/673,791

(22) Filed: Feb. 12, 2007

(65) Prior Publication Data

US 2007/0138318 A1 Jun. 21, 2007

(51) Int. Cl.

| | |
|---|---|
| ***B05B 7/02*** | (2006.01) |
| ***F23D 11/46*** | (2006.01) |
| ***F23D 14/60*** | (2006.01) |
| *B05B 9/04* | (2006.01) |

(52) U.S. Cl. ..... 239/528; 239/525; 239/527; 239/302; 239/333; 239/351; 222/333

(58) Field of Classification Search ..... 239/332, 239/333, 351, 329, 302, 353, 525, 527, 528; 222/333

See application file for complete search history.

(56) References Cited

U.S. PATENT DOCUMENTS

| | | | | |
|---|---|---|---|---|
| 4,809,884 | A * | 3/1989 | Stackhouse | 222/153.04 |
| 5,004,123 | A * | 4/1991 | Stoody | 222/94 |
| 5,150,841 | A * | 9/1992 | Silvenis et al. | 239/332 |
| 5,377,875 | A * | 1/1995 | Kock et al. | 222/95 |
| 5,884,845 | A * | 3/1999 | Nelson | 239/333 |
| 6,474,507 | B1 | 11/2002 | Hornsby et al. | |
| 6,554,211 | B1 * | 4/2003 | Prueter et al. | 239/332 |
| 6,752,330 | B2 * | 6/2004 | DiMaggio et al. | 239/337 |
| 6,860,782 | B2 | 3/2005 | Hornsby et al. | |
| 6,892,902 | B2 | 5/2005 | Hornsby et al. | |
| D519,371 | S | 4/2006 | Hornsby et al. | |
| 7,097,119 | B2 | 8/2006 | Hornsby et al. | |
| 7,246,755 | B2 | 7/2007 | Hornsby et al. | |
| 7,328,859 | B2 | 2/2008 | Hornsby et al. | |
| 7,384,006 | B2 | 6/2008 | Hornsby et al. | |
| 7,451,900 | B2 | 11/2008 | Hornsby et al | |
| 2002/0020712 | A1 | 2/2002 | Hornsby et al. | |
| 2003/0052194 | A1 * | 3/2003 | Streutker et al. | 239/333 |
| 2003/0178439 | A1 | 9/2003 | Hornsby et al. | |
| 2005/0133540 | A1 | 6/2005 | Hornsby et al. | |
| 2005/0133624 | A1 | 6/2005 | Hornsby et al. | |
| 2005/0133626 | A1 | 6/2005 | Hornsby et al. | |

(Continued)

*Primary Examiner*—Len Tran
*Assistant Examiner*—James S Hogan

(57) ABSTRACT

A manually operated sprayer for a container of liquid to be sprayed includes variable volume pump means having liquid inlet and outlet means for discharging the contents of the container. The sprayer further includes a control module having product and vent valves reciprocably disposed therein, the product and vent valves being simultaneously reciprocable by means of the manual actuator between valve open and valve closed positions. In the valve open position, the product and vent valves respectively prevent flow of product and air respectively into the liquid inlet means and into a vent passage in communication between atmosphere and an interior of the container, and in the vent closed position, the product and vent valves respectively enable flow of product and air respectively into the liquid inlet means and into the vent passage.

7 Claims, 2 Drawing Sheets

U.S. PATENT DOCUMENTS

2005/0133627 A1 6/2005 Hornsby et al.
2006/0000854 A1 1/2006 Hornsby et al.
2006/0076434 A1 4/2006 Hornsby et al.
2007/0075099 A1 4/2007 Hornsby et al.
2007/0228186 A1 10/2007 Hornsby et al.
2008/0237371 A1 10/2008 Hornsby et al.
2009/0032618 A1 2/2009 Hornsby et al.

* cited by examiner

DISCHARGE/VENT MODULE FOR POWER SPRAYER

BACKGROUND OF INVENTION a. Field of Invention

The invention relates generally to manually actuated power sprayers for mounting to containers of liquids to be sprayed, and more particularly to a trigger operated power sprayer having improved container vent and product discharge controls during pump activation.

b. Description of Related Art

Manually actuated power sprayers, which are well known in the art, may include trigger sprayers adapted for manual operation in dispensing of product from a container attached thereto. During operation of the power sprayer, the container to which the manually actuated power sprayer is mounted must be vented to atmosphere to replenish the container interior with air as liquid product is dispensed. If the container is not properly and efficiently vented, the air volume or head space volume within the container which enlarges as the container is emptied of product eventually becomes sub-atmospheric thereby creating unwanted conditions of hydraulic lock and container collapse. Container venting may be carried out in a multitude of ways, utilizing both active and passive valving. While container vent control may be avoided when using, for example, a collapsible bag as the container of product is dispensed, there exist a multitude of containers and products on the market for which collapsible bags are unavailable or economically prohibitive.

For improved operation of the power sprayer for which venting is required, the function of the vent as well as the product discharge controls must be coordinated such that the container is adequately vented while product is being discharged. Container vent and product discharge valving must also be controlled such that during periods of shipping and storage and other periods of non-use, the vent and product discharge ports remain sealed closed to avoid the possibility of leakage. At the same time, the vent and discharge valve controls must be efficient and economical in use during operation of a power sprayer, and must likewise be efficient and economical to fabricate and assemble into the power sprayer unit.

Among conventional trigger sprayers having a container vent control is one with a flexible seal member for covering a vent hole to prevent leakage of product and to permit venting of the container during dispensing. Heretofore, conventional seal designs have been quite complex and have thus required relatively complicated manufacturing and assembly techniques. For example, conventional vent seals disclosed in U.S. Pat. No. 4,230,277, the disclosure of which is incorporated herein by reference, include non-geometric or complex geometric cross-sections, or protrusions or the like integrally molded therewith as in, for example, U.S. Pat. No. 5,603,434, the disclosure of which is also incorporated herein by reference. The fabrication and installation of such complex prior art designs can significantly increase the overall manufacturing and assembly costs of the trigger sprayer. Other effective container vent controls, as disclosed in U.S. Pat. No. 6,554,211, the disclosure of which is incorporated herein by reference, could also be improved upon in operation.

There thus exists room for improvement in the number of parts, the overall costs associated with manufacturing and assembly, as well as the operation of existing manually activated sprayers, whether such sprayers are of the manual pumping type or of the battery activated type, so long as such sprayers require container vent and product discharge controls.

It would therefore be of benefit to provide a manually actuated pump sprayer having in combination improved means for container venting and product discharge control operable in a repeatable and predictable manner over the life of the pump sprayer. There also remains a need for an improved means for container venting and product discharge control, which is robust in design, efficient to operate, simple to assemble and disassemble, and which is economically feasible to manufacture.

SUMMARY OF INVENTION

The invention solves the problems and overcomes the drawbacks and deficiencies of prior art container vent and product discharge control designs for manually actuated or battery operated sprayers by providing in combination improved means for container venting and product discharge control for improved sprayer operation.

The invention thus provides a manually operated sprayer for a container of liquid to be sprayed. The sprayer includes a variable volume pump means having liquid inlet means for connecting the pump means with liquid in the container, outlet means connecting the pump means with a discharge opening and a manual actuator for activating the pump means for pumping liquid from the container through the outlet means and the discharge opening. The sprayer further includes a control module having spring biased product and vent valves reciprocably disposed therein, the product and vent valves being simultaneously reciprocable by means of the manual actuator between valve open and valve closed positions. In the valve open position, the product and vent valves respectively prevent flow of product and air respectively into the liquid inlet means and into a vent passage in communication between atmosphere and an interior of the container. In the valve closed position, the product and vent valves respectively enable flow of product and air respectively into the liquid inlet means and into the vent passage.

For the sprayer described above, the product and vent valves may sealingly engage confronting internal walls in the control module to prevent flow of product and air. In a particular embodiment, the product and vent valves may each include a resilient conical section in the form of chevron seals for sealingly engaging confronting internal walls in the control module to prevent flow of product and air. The product and vent valves may be formed of a single unitary structure, or may instead be formed of a plurality of components fitted together. The product and vent valves may include a first elongated section and a second cap section fitted together. The first elongated section may include a first conical portion tapered outwardly to engage a confronting internal wall in the control module, a second elongated portion and a third elongated portion. The cap section may include a first conical portion tapered outwardly to engage another confronting internal wall in the control module, and a second elongated portion. The conical portions of the first elongated section and the second cap section may engage the confronting internal walls of the control module to prevent flow of product and air. The actuator may be depressable to first operate the pump means and thereafter activate the product and vent valves to enable flow of product and air into the liquid inlet means and the vent outlet passage, respectively. The manual actuator may include first and second protrusions for respectively operating a switch for engaging the motor means and thereafter operating the product and vent valves for enabling flow of product and air into the liquid inlet means and the vent outlet passage, respectively. The manual actuator may include a trigger lever which is normally returned to a relaxed position by a spring outwardly biasing the product and vent valves upon release of manual pressure applied to the lever. The sprayer may include electric motor means for operating the pump means, battery means for operating the motor means, and manually operable switch means for selectively operating the motor means.

The invention yet further provides a manually operated sprayer for a container of liquid to be sprayed. The sprayer includes a variable volume pump means having liquid inlet means for connecting the pump means with liquid in the container, outlet means connecting the pump means with a discharge opening and a manual actuator for activating the pump means for pumping liquid from the container through the outlet means and the discharge opening. The sprayer includes a control module having spring biased product and vent flow control means disposed therein, the product and vent flow control means being operable by means of the manual actuator between valve open and closed positions. In the valve open position, the product and vent flow control means respectively prevent flow of product and air respectively into the liquid inlet means and into a vent passage in communication between atmosphere and an interior of the container. In the valve closed position, the product and vent flow control means respectively enable flow of product and air respectively into the liquid inlet means and into the vent passage.

For the sprayer described above, the product and vent flow control means may sealingly engage confronting internal walls in the control module to prevent flow of product and air. In a particular embodiment, the product and vent flow control means may each include a resilient conical section sealingly engaging confronting internal walls in the control module to prevent flow of product and air. The product and vent flow control means may be formed of a single unitary structure, or may instead be formed of a plurality of components fitted together. The product and vent flow control means may include a first elongated section and a second cap section fitted together. The first elongated section may include a first conical portion tapered outwardly to engage a confronting internal wall in the control module, a second elongated portion and a third elongated portion. The cap section may include a first conical portion tapered outwardly to engage another confronting internal wall in the control module, and a second elongated portion. The conical portions of the first elongated section and the second cap section may engage the confronting internal walls of the control module to prevent flow of product and air. The actuator may be depressable to first operate the pump means and thereafter activate the product and vent flow control means to enable flow of product and air into the liquid inlet means and the vent outlet passage, respectively. The manual actuator may include first and second protrusions for respectively operating a switch for engaging the motor means and thereafter operating the product and vent flow control means for enabling flow of product and air into the liquid inlet means and the vent outlet passage, respectively. The manual actuator may include a trigger lever which is normally returned to a relaxed position by a spring outwardly biasing the product and vent flow control means upon release of manual pressure applied to the lever. The sprayer may include electric motor means for operating the pump means, battery means for operating the motor means, and manually operable switch means for selectively operating the motor means.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1:
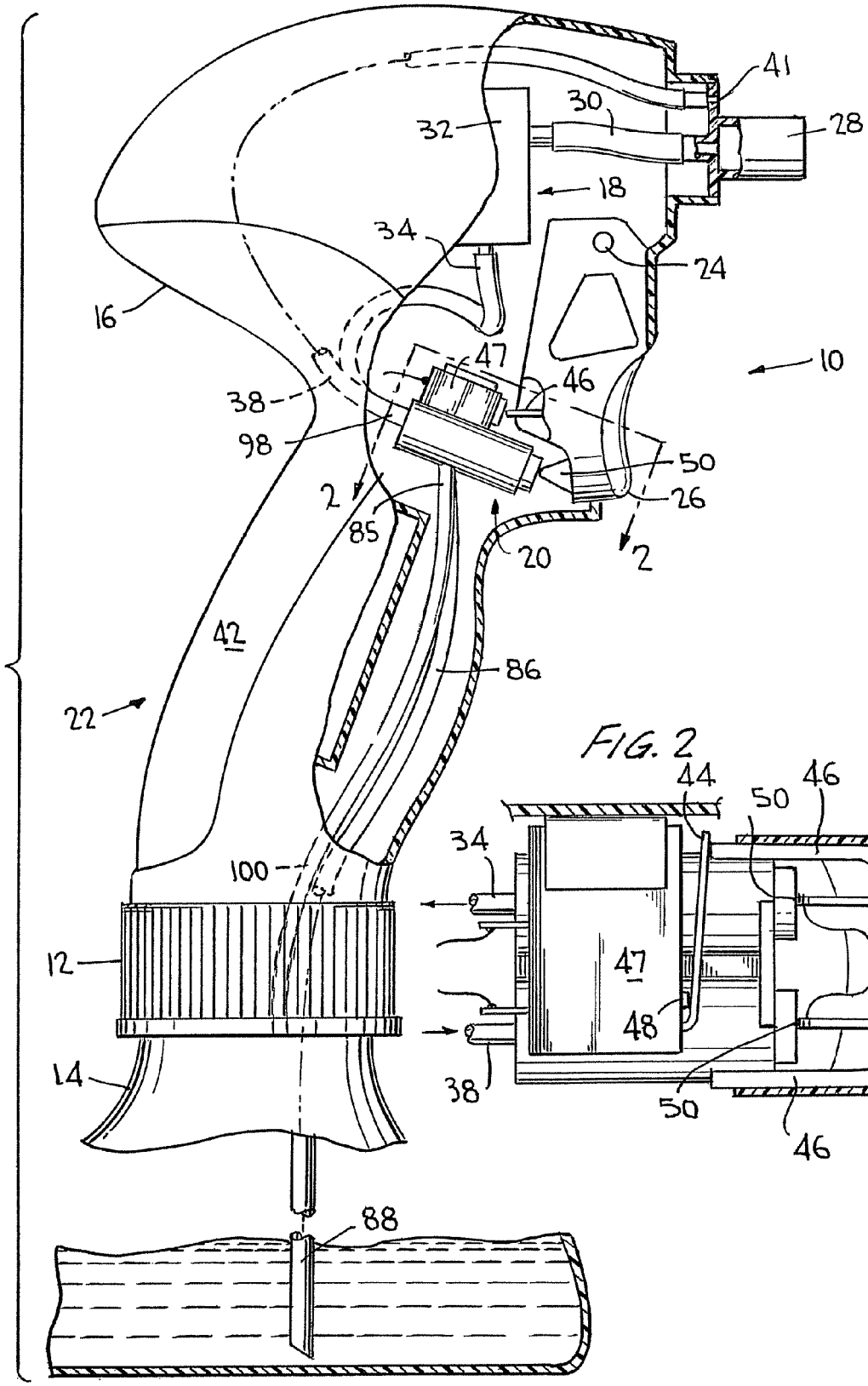
FIG. 1 is a side elevation view of the power sprayer, partly broken away, according to the present invention.

Referring now to the drawings wherein like reference numerals designate corresponding parts throughout the several views, FIGS. 1-5 illustrate a battery operated power sprayer according to the present invention, generally designated power sprayer 10.

Before proceeding with the detailed description of power sprayer 10, those skilled in the art will appreciate in view of this disclosure that the components and features of sprayer 10 discussed herein may be applicable for use with a manual pumping type sprayer (not shown) or for use with the battery activated type sprayer as shown in FIG. 1.

Referring to FIG. 1, power sprayer 10 of the present invention is shown as having coupled thereto a container closure 12 for mounting the sprayer to a container 14 of liquid product to be sprayed. Power sprayer 10 may generally include housing 16 made of a suitable plastic material, for example, and having enclosed therein pump system 18, container vent and product discharge control module 20 (hereinafter "control module 20") and power unit 22.

As shown in FIG. 1, power sprayer 10 may have hingedly mounted thereto as at 24 an actuator which may comprise a trigger lever 26 for actuating sprayer 10. Housing 16 may include a discharge nozzle cap 28 affixed thereon and including a discharge orifice (not shown) formed therein at the terminal end of discharge tube 30 of the sprayer. Discharge tube 30 may be operatively connected to pump 32 of pump system 18 for discharging product from container 14 under pressure as needed. Pump 32 may include a variable volume pump chamber (not shown) into which an inlet passage extends. Product outlet tube 34 may be operatively connected at one end thereof to the inlet passage of pump 32, and to product side 36 of control module 20 at the other end thereof. A vent inlet tube 38 may include one end thereof operatively connected to vent side 40 of control module 20, and the other end thereof connected to an opening 41 adjacent the discharge orifice of discharge nozzle cap 28 for venting container 14 during use. Pump 32 may be operated by an electric motor (not shown) disposed behind pump 32 via gearing and cams in a manner similar to that disclosed in U.S. Pat. No. 5,716,007, the disclosure of which is incorporated herein by reference. A pair of batteries (not shown) may be housed within suitable compartments of the sprayer in power unit 22, and may be insertable from the rear end of sprayer 10. A battery cover 42 may be used to cover the batteries and may be snap-fitted in place onto power sprayer 10, as shown in the closed configuration of FIG. 1.

Figure 2:
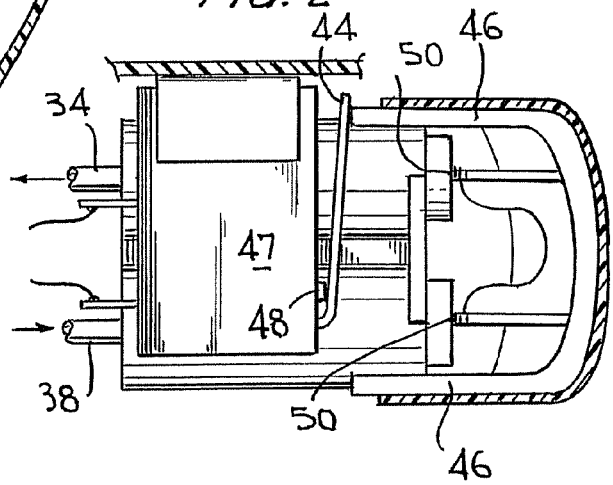
FIG. 2 is a cross-sectional view of the power sprayer of FIG. 1, taken substantially along line 2-2 in FIG. 1, illustrating the contact arrangement for operating the power sprayer.

Referring to FIG. 2, a metal spring leg 44 may be mounted to the sprayer such that when depressed by means of arms 46 of trigger lever 26, a depressable on/off switch 48 energizes control mechanism 47 for allowing current to flow to the motor for pump system 18 for operating pump 32. Upon the release of trigger lever 26, outwardly biased spring leg 44 releases switch 48 to its off position so as to shut off the motor for pump system 18 and thereby prevent product from being discharged out through the orifice of discharge nozzle cap 28. It would be apparent to those skilled in the art in view of this disclosure that instead of depressable on/off switch 48, other arrangements, such as a metal contact spring leg 44 directly contacting a battery metal contact to close an electrical circuit upon being depressed by means of arms 46 of trigger lever 26, could be utilized for allowing current to flow to the motor for pump system 18 for operating pump 32.

As shown in FIGS. 1 and 2, in addition to arms 46, trigger lever 26 may include projections 50 in contact with product and vent valves 52, 54 for controlling the operation thereof. In the embodiment shown, arms 46 and projections 50 may be configured such that by manually depressing trigger lever 26, arms 46 initially press spring leg 44 to engage switch 48, and thereafter, projections 50 simultaneously engage product and vent valves 52, 54 to press valves 52, 54 to allow product and air to pass via valves 52, 54 after a slight delay.

Referring to FIGS. 1 and 3-5, the configuration and operation of control module 20 will next be described in detail.

Figure 3:
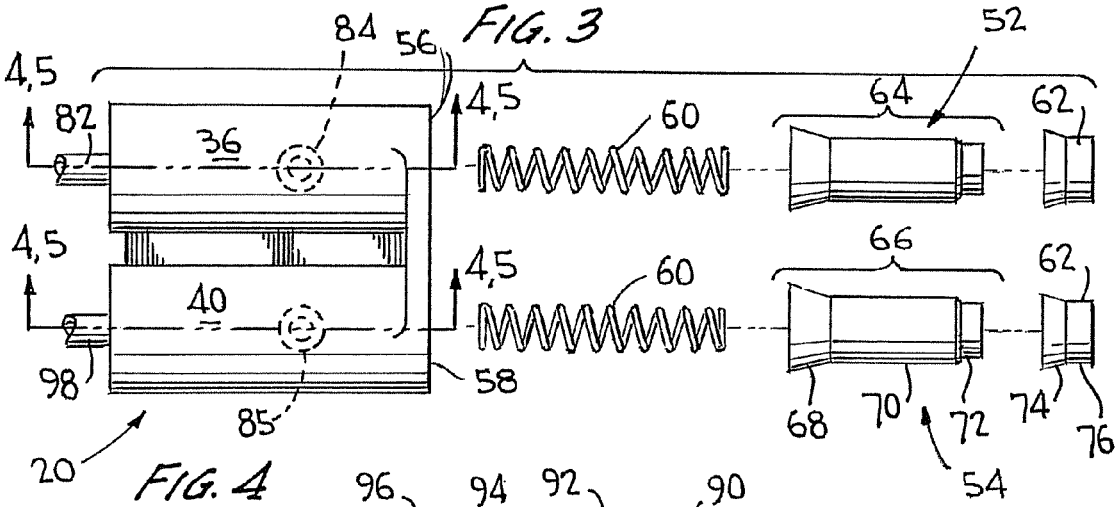
FIG. 3 is an exploded view of the discharge/vent control module of the power sprayer of FIG. 1.

Specifically, as shown in FIG. 3, product and vent valves 52, 54, respectively, of control module 20 may be respectively housed in product and vent housings 56, 58, and biased outwardly by means of springs 60. Product and vent valves 52, 54 may be formed of a two-piece structure including caps 62 assembled onto elongated valve sections 64, 66 for ease of manufacture, but may be manufactured of a one piece structure as would be apparent to those skilled in the art.

Figure 4:
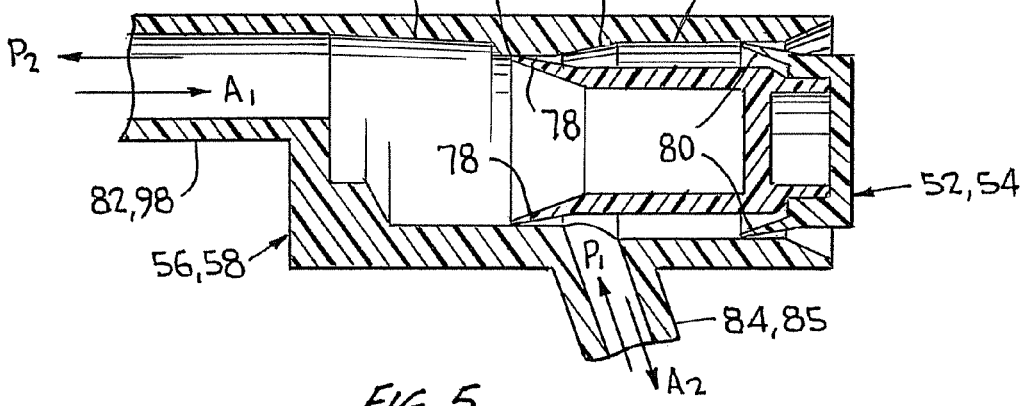
FIG. 4 is an illustrative cross-sectional view of the discharge/vent control module of FIG. 3, taken substantially along line 4,5-4,5 in FIG. 3, illustrating a product valve and an identical vent valve in a closed position.
Figure 5:
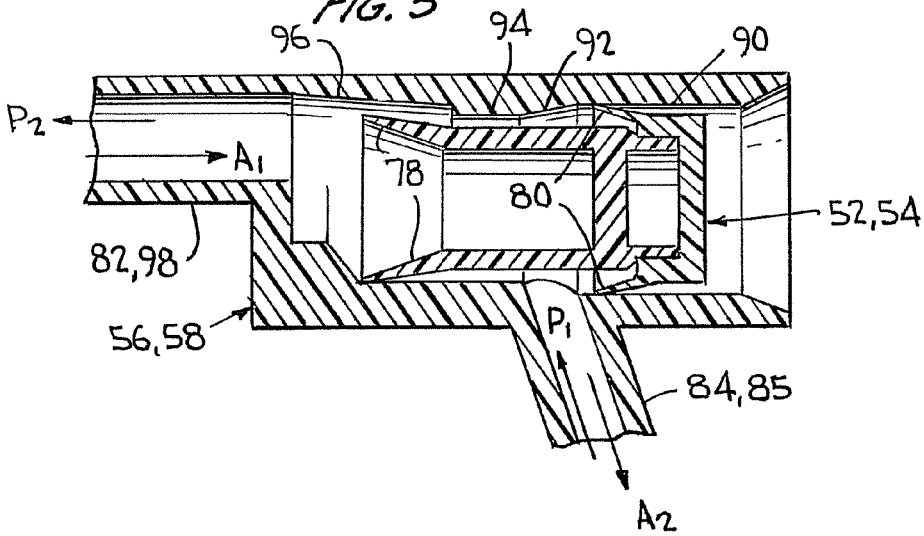
FIG. 5 is similar to FIG. 4 showing the product valve and the identical vent valve in an open position.

Referring next to FIGS. 4 and 5, which respectively illustrate cross-sectional views of the module of FIG. 3, taken along lines 4-4 and 5-5 in FIG. 3, product valve 52 is illustrated in closed and opened positions respectively. It is to be understood that the layout and operation of vent valve 54 and vent housing 58 are identical to that of product valve 52 and product housing 56. Accordingly, the description hereinafter of product valve 52 and product housing 56 will likewise apply identically to vent valve 54 and vent housing 58.

Specifically, as shown in FIGS. 3 and 4, product and vent valves 52, 54, may each include fixedly connected first and second sections designated as elongated valve section 64 and cap 62. Elongated valve section 64 may include a first conical portion 68, a second elongated portion 70, and a third elongated portion 72 having a reduced diameter cross-section as compared to portion 70. Elongated portions 70, 72 may be formed of a uniform cross-section along the central longitudinal axis of valve 52. Elongated portion 72 may be dimensioned to fit within the cavity in cap 62, as shown in FIG. 4. Cap 62 may include a conical portion 74 and an elongated portion 76 formed of a uniform cross-section along the central longitudinal axis of cap 62. For assembly, elongated valve section 64 and cap 62 may be fitted together as shown in FIG. 4 and retained in the configuration of FIG. 4 by means of friction or other such means known in the art. Conical portions 68 and 74 of elongated valve section 64 and cap 62, respectively, may include a tapered internal configuration to define resilient seal members 78, 80 as shown in FIG. 4. When fitted within product housing 56, resilient seal members 78, 80 sealingly engage the confronting walls of housing 56 to form a seal. Likewise, when fitted within vent housing 58, resilient seal members 78, 80 sealingly engage the confronting walls of housing 58 to form a seal.

Referring to FIG. 4, product housing 56 may generally include outlet end 82 having product outlet tube 34 connected thereon and inlet end 84 having product inlet tube 86 connected thereon. Product inlet tube 86 may be connected to a dip tube 88 disposed in container 14 through container closure 12. Likewise, vent housing 58 may generally include outlet end 85 having vent outlet tube 100 connected thereon and inlet end 98 having vent inlet tube 38 connected thereon. In the particular embodiment shown, housing 56 may include first through fourth cross sectional areas 90, 92, 94 and 96, respectively. Areas 90 and 94 may include a generally uniform cross-section along the central longitudinal axis of housing 56, whereas areas 92 and 96 may be tapered inwardly and outwardly, respectively, as shown in FIGS. 4 and 5. It would be apparent to those skilled in the art that the specific cross-sectional configurations shown for housings 56 and 58 are for illustrative purposes only, and are not intended to limit the scope of the present invention to the specific embodiment shown.

Once fitted within housing 56, as shown in FIG. 4, resilient members 78, 80 of product valve 52 may be respectively disposed in engagement with areas 94 and 90 of housing 56 for sealing product valve 52 in a closed, at-rest position. Likewise, once fitted within housing 58, as shown in FIG. 4, resilient members 78, 80 of vent valve 54 maybe respectively disposed in engagement with areas 94 and 90 of housing 58 for sealing vent valve 54 in a closed, at-rest position. When trigger lever 26 is pressed to operate pump system 18 by means of the engagement of spring leg 44 and switch 48, as briefly discussed above and as shown in FIG. 5, protrusions 50 of trigger lever 26 simultaneously move product and vent valves 52, 54 inwards within housings 56, 58, respectively. In the FIG. 5 position of product valve 52, the inlet to the pump is valved open such that product within container 14 may be suctioned in through inlet end 84 in the direction of arrow-P1, around the outer circumference of portions 68 and 70 of valve 52, and out through outlet end 82 in the direction of arrow-P2 to then be fed into product outlet tube 34, and out through discharge tube 30 via pump 32. Likewise, in the FIG. 5 position of vent valve 54, the air vent is opened such that air may be suctioned in through opening 41 (FIG. 1) and then through inlet end 98 in the direction of arrow-A1, around the outer circumference of portions 68 and 70 of valve 54, and out through outlet end 85 in the direction of arrow-A2 to then be fed into vent outlet tube 100 into container 14. Upon the release of trigger lever 26, product and vent valves 52, 54 return to their rest position shown in FIG. 4 under the bias of spring 60.

As discussed above, various modifications may be made to power sprayer 10 without departing from the scope of the present invention. For example, seal rings or other such means may be used instead of resilient members 78 and 80 on valves 52, 54 for sealing the respective inlet and outlet ends of the valves from air or product as needed. Moreover, instead of the axially reciprocable vent valves 52, 54 illustrated, flap valves may be provided within control module 20 and be operable by trigger lever 26 to control flow of air and product as needed.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A trigger sprayer, comprising:

a module body;

a vent valve in the module body comprising:

a first conical portion;

a second elongated portion connected to the first conical portion and having a cross sectional area smaller than the first conical portion;

a third elongated portion connected to the second elongated portion and having a cross sectional area smaller that the second elongated portion; and a cap fitted to the third elongated portion, wherein the cap comprises a cap conical portion;

a product valve in the module body;

a trigger lever in communication with the vent valve and product valve, wherein activation of the trigger lever opens the vent valve and the product valve;

a motor; and a spring leg in communication with the motor, wherein activation of the trigger lever depresses the spring leg and activates the motor.

2. The trigger sprayer of claim 1, wherein activation of the trigger lever activates the motor before opening the vent valve and the product valve.

3. The trigger sprayer of claim 1, wherein the product valve further comprises:

a first conical portion;

a second elongated portion connected to the first conical portion and having a cross sectional area smaller than the first conical portion;

a third elongated portion connected to the second elongated portion and having a cross sectional area smaller that the second elongated portion; and a cap fitted to the third elongated portion, wherein the cap comprises a cap conical portion.

4. The trigger sprayer of claim 3, further comprising a product housing in the module body, comprising:

a first cross sectional area;

a second cross sectional area having a smaller diameter than the first cross sectional area;

a third cross sectional area having a greater diameter than the second cross sectional area; and a fourth cross sectional area having a smaller diameter than the third cross sectional area, wherein the product valve sits in the product housing and the first conical portion of the product valve abuts the third cross sectional area in a product valve closed position.

5. The trigger sprayer of claim 1, further comprising a vent housing in the module body, comprising:

a first cross sectional vent area;

a second cross sectional vent area having a smaller diameter than the first cross sectional area;

a third cross sectional vent area having a greater diameter than the second cross sectional area; and a fourth cross sectional vent area having a smaller diameter than the third cross sectional area, wherein the vent valve sits in the vent housing and the first conical portion of the vent valve abuts the third cross sectional vent area in a vent valve closed position.

6. A trigger sprayer, comprising:

a housing;

a valve module contained in the housing;

a vent housing in the valve module, the vent housing comprising:

a first cross sectional vent area;

a second cross sectional vent area, the second cross sectional vent area having a smaller diameter than the first cross sectional vent area;

a vent inlet in communication with the first cross sectional vent area; and a vent outlet in communication with the second cross sectional vent area;

a vent valve section positioned in the vent housing, the vent valve section comprising:

a conical portion positioned between the first cross sectional vent area and the second cross sectional vent area, wherein the conical portion abuts the second cross sectional vent area in a closed position; and an elongated valve section connected to the conical portion;

a product housing in the valve module, the product housing comprising:

a first cross sectional product area;

a second cross sectional product area, the second cross sectional product area having a smaller diameter than the first cross sectional product area;

a product outlet in communication with the first cross sectional product area; and a product inlet in communication with the second cross sectional product area;

a product valve section positioned in the product housing, the product valve section comprising:

a product conical portion positioned between the first cross sectional product area and the second cross sectional product area, wherein the product conical portion abuts the second cross sectional product area in a closed position; and an elongated product valve section connected to the product conical portion;

a trigger lever in communication with the elongated valve section and the elongated product valve section.

7. The trigger sprayer of claim 6, further comprising:

a motor; and a spring leg in communication with the motor and the trigger lever, wherein activation of the trigger lever depresses the spring leg and activates the motor.

* * * * *